United States Patent [19]

Akerström

[11] 4,245,833

[45] Jan. 20, 1981

[54] DEVICE FOR FEEDING AND STACKING FORMS IN A BOX

[75] Inventor: Bengt Åkerström, Lidingö, Sweden

[73] Assignee: Hugin Kassaregister AB, Stockholm, Sweden

[21] Appl. No.: 24,438

[22] Filed: Mar. 27, 1979

[30] Foreign Application Priority Data

Apr. 3, 1978 [SE] Sweden ..... 7803718

[51] Int. Cl.[3] ..... B65H 29/18; B65H 31/06

[52] U.S. Cl. ..... 271/198; 271/177; 271/214; 271/303

[58] Field of Search ..... 271/214, 215, 198, 202, 271/177, 178, 181, 212, 303; 414/107, 109, 92

[56] References Cited

U.S. PATENT DOCUMENTS

| | | | |
|---|---|---|---|
| 3,162,439 | 12/1964 | Poland et al. | 271/214 X |
| 3,517,924 | 6/1970 | Digilio et al. | 271/177 |
| 3,704,793 | 12/1972 | Nicol et al. | 271/178 X |
| 3,729,188 | 4/1973 | Stephenson | 271/303 |
| 3,998,451 | 12/1976 | McInerny | 271/212 |

*Primary Examiner*—Bruce H. Stoner, Jr.
*Attorney, Agent, or Firm*—Darby & Darby

[57] ABSTRACT

A device for feeding and stacking documents in a box uses a driven endless belt arranged to sweep tightly along an open side of the box whereby documents may be taken in succession from a feeding station along the belt to the box. The open side of the box is oriented substantially vertically for receiving and thus stacking the documents in an upright position, and a guide roller with an over-shooting guide sheet is located adjacent the bottom edge of the open side to guide upwardly the belt and any form thereon to the open side of the box and to a belt roller located at a higher level than the guide means, while forming an acute angle with the plane of the open side, so that the trailing edge of each document snaps out from contact with the guide sheet before its leading edge abuts a stop surface provided at the upper edge of the box.

4 Claims, 1 Drawing Figure

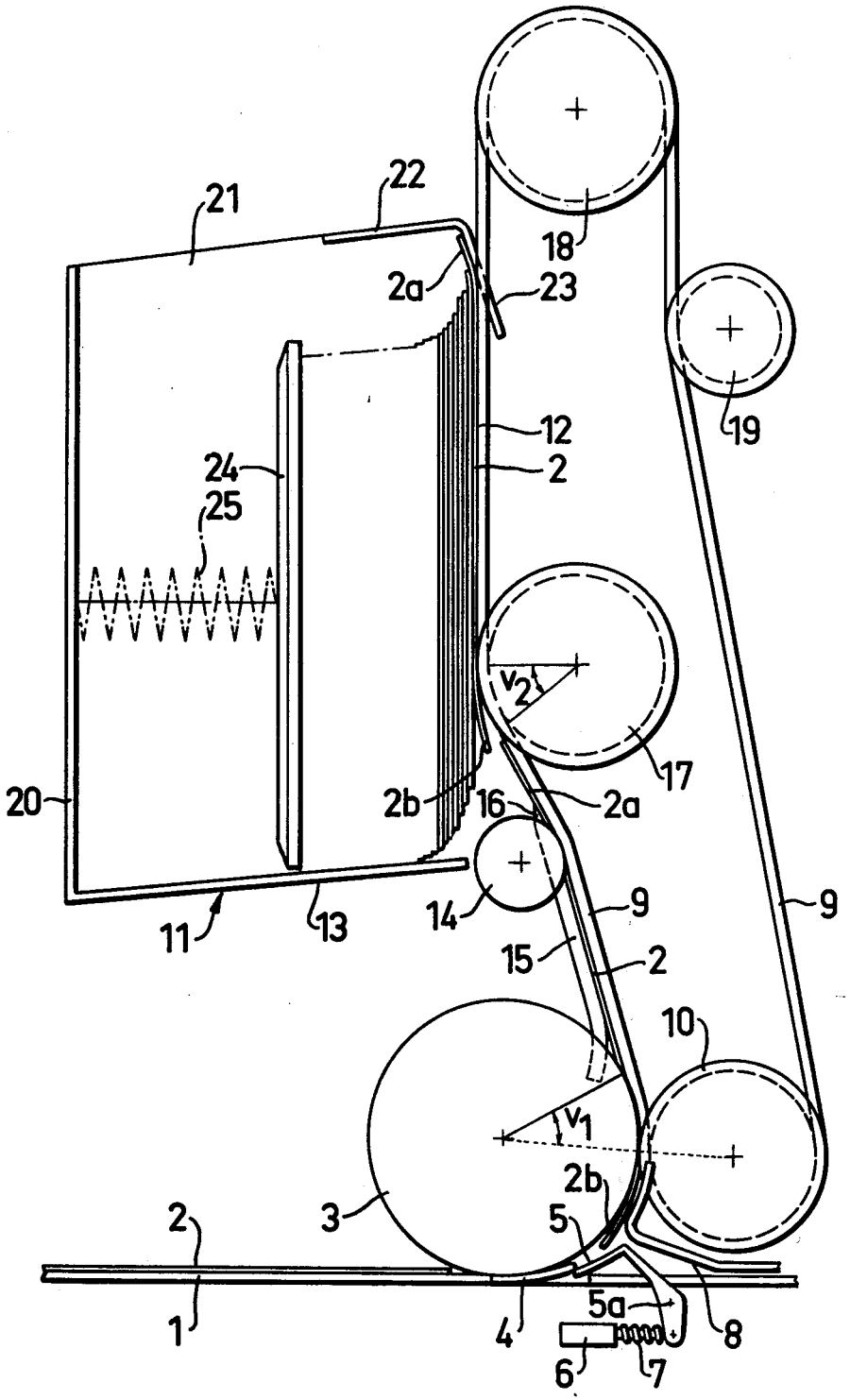
21
22
18
2a
23
19
12
24
2
25
$v_2$
17
20
2b
16
2a
14
9
9
11
13
15
2
10
$v_1$
2b
3
5
2
5a
1
4
8
6
7

DEVICE FOR FEEDING AND STACKING FORMS IN A BOX

This invention relates to a device for feeding and stacking forms in a box by using at least one endless belt, which driven by a roller sweeps tightly along an open side of the box for taking along subsequent forms and inserting them into the box.

At conventional devices of this kind, there is risk of collision between the rear edge of a form being fed into the box and the forward edge of the form following next on the belt. Such collision can give rise to various complications. Problems also can be caused by a decrease in feed speed due to belt elongation and by uncontrolled bulging of the forms.

These risks and problems are eliminated according to the present invention, in that the open side of the box is oriented substantially vertically for the stacking of forms in upright position, and a guide member is located adjacent the bottom edge of the open side to guide the form-carrying belt angularly to said open side inward against and upward onto a belt roller located on a higher level than the guide member, so that the rear edge of the form has become free of its contact with the guide member. before the forward edge of the form having been advanced by the belt abuts a lying stop surface at the upper edge of the box, and thus said rear edge, due to the elasticity of the form, has sprung away from its abutment to the angular belt portion between the guide member and the belt roller, thereby providing collision-free access for the form following next, which is inserted into the box upon the first form and in its turn is stopped upon its impact against the stop surface, in turn, for each of the subsequent forms.

As a further safeguard against collision and complications in connection with the feed of forms into the box, due to previous forms having been creased or bulged, a further development of the invention implies stretching of the form while it is being fed into the box.

The invention is described in greater detail in the following, with reference to the accompanying drawing, which in a schematic manner shows the device according to the invention applied to an installation for sorting paper forms of equal size carrying different data (for example pools coupons) into corresponding boxes of the kind shown in the drawing.

From a supply (not shown) of unsorted forms one form 2 after the other are transported in spaced relationship on a schematically indicated continuously running web 1 to a drive roller 3. During their transport, the forms are read. For reason of better understanding, the thickness of the forms is shown substantially exaggerated. The web 1, which in practice in most cases is formed of a plurality of pairs of drive rollers with a division smaller than the length of the form, continues past subsequent sorting boxes. Beneath the drive roller 3 an elastic guide edge 4 is mounted, beneath which a guide cam 5 is pivoted in a point 5*a*. Said cam (in the position shown) can be pivoted upward instantaneously in response to an impulse from the reading device, which energizes an electromagnet 6 against the action of a spring 7 when the form carries data corresponding to the box shown. In the absence of such impulse, the guide cam 5 remains in a position where its guide surface is below the web surface. In such a case the form is driven over the guide edge 4 for continued transport.

As an additional safety measure, a guide bar 8 is placed between the drive roller 3 and the belt roller 10.

The drive roller 3 is in driving engagement with an endless belt 9, which is pressed against the drive roller by an opposite, preferably resiliently mounted first belt roller 10, which here is shown to serve as an end or guide roller for the belt coil 9.

From this belt engagement the belt runs at an angle inclined to the dotted connecting line between the axles of the drive and belt roller 3 and, respectively, 10 in the direction inward to the open side 12 of the box 11 and passes a deflection roller 14 mounted adjacent the edge of the box bottom 13. Between the drive roller and the deflection roller a guide sheet 15 extends, which terminates in a guide edge 16 beyond the contact place between the belt 9 and the deflection roller 14, in order to break possible adhesion forces between the deflection roller and the forward edge 2*a* of the form 2 when said edge leaves said contact place.

From the deflection roller 14 the belt 9 runs inclined inward to the open side 12 of the box and there runs over a second belt roller 17, which co-operates with a third belt roller 18 located above said second roller 17 and serving as the second end roller of the belt coil, thereby causing the form-carrying belt to tightly sweep past the open box side. 19 designates a tension roller. The box 11 is formed of said slightly inclined bottom 13, a side wall 20, a rear wall 21 and opposite thereto an open front wall, and an inclined roof portion or stop surface 22 with downwardly facing guide fingers 23 (either enclosing the belt 9 or engaging in gaps between partial belts in a multi-part belt) for guiding the forward edge 2*a* of the form inward to the stop surface 22. The box further includes a thrust plate 24, which is actuated in the direction to the open side 12 by a resilient prestressing member, which here is indicated symbolically as a compression spring 25 abutting the side wall 20 of the box. Said thrust plate has the object to maintain the forms fed into the box to flatly abut each other. After the completed filling of the box the stack of forms is removed from the open front side of the box.

From the above-described device substantially also its mode of operation is apparent, which briefly is as follows.

The form 2 is advanced on its web 1 against the guide edge 4 and—at the embodiment shown in the FIGURE—against the guide cam 5, which by actuation of the electromagnet 6 against the action of the spring 7 is pivoted upward. It is to be observed in this connection, that the pressure from the forward edge of the form by friction against the cam 5 acts in a direction assisting the electromagnet 6, which is not the case with the conventional deflection constructions where the pressure of the form instead counteracts the effect of the electromagnet. The form 2, which by means of the cam 5 has been engaged between the belt 9 and the drive roller 3, is moved upward against the deflection roller 14 and during this movement guided by the guide sheet 15. Owing to the bending of the belt about the drive roller—here shown to cover a winding angle $v_1$—the inner surface of the belt which drives the form is contracted relative to the outer surface of the belt, which implies that the speed of the belt after the angle v exceeds the circumferential speed of the drive roller 3. At the encircling of the belt over the belt roller 17 with the angle $v_2$, the outer surface of the belt is given a further increase in speed owing to elongation. Due to the fact that the form according to the FIGURE has such a size (length), that its forward edge 2a is given the increased speed over the winding angle $v_2$ of the belt roller 17 before the rear edge 2b of the form has left the winding angle $v_1$ of the drive roller 3, a stretching of the form is obtained whereby possible folds are planed.

Due to the normally high speed of the belt (in the typical case more than ten forms per second), the forms strike against the stop surface 22 with their forward edge 2a at a high speed and bounce downward. This should imply collision risk with the next form, if the device described were not such, that the rear edge 2b of the form has lost its contact with the deflection roller 14 before said impact occurs, and said rear edge due to its inherent rigidity or elasticity has sprung away from the belt (as shown in the FIGURE). As an additional safety against extremely high impact speeds, the forward edge of the form is braked upon its contact with the guide portion of the fingers 23 located inside of the belt 9. The upper guide edge 16 of the guide sheet 15 provides additional safety by preventing the forward edge 2a of the form following next from adhering to the circumference of the deflection roller 14 due to electrostatic forces giving rise to friction.

It also should be pointed out that as a result of the encircling of a portion of the belt roller 17 by the belt an extra stretching of the form is obtained when the form is being inserted into the box 11, analogous to the conditions at the drive roller 3.

Owing to the gravity and the bounce of the rapidly inserted form against the stop surface in the box, the forms subsequently inserted form themselves in the way indicated by dash-dotted lines in the FIGURE and press back the thrust plate 24 against the action of the prestressed spring 25. It also was found that a contributing factor to the correct stacking of the forms in the box are the vibrations, which develop partly by the bounce of the forward form edge and partly by the sudden release of the rear edge of the stretched form at the drive roller 3 as well as at the belt roller 17.

The device according to the invention described above by way of example for safely avoiding even at high form feed speed disturbances in the form handling caused by form collisions can be modified in several ways within the scope of the invention. The feed to the guide roller, which in principle can be replaced by another guide member, possibly simply by a fixed round wire or slide shoe, can be effected in a way other than the one shown, depending on the prevailing or desired prerequisites. The bottom of the box has been shown inclined to facilitate the form stacking, but also a horizontal bottom can be imagined. A rearward inclination of the rear wall of the box up to 45° or more may be of advantage, both for additionally straightening and stabilizing the form stack and for providing space for comfortably cleaning the form path, especially for removing unavoidable paper fragments from the same. By placing the box above the transport path, a comfortable working position both for removing the forms and for cleaning the transport path is obtained. The prestressing force of the thrust plate can be brought about in another way than by a spring. The components shown in general can be replaced by other components having the same or a similar effect.

What I claim is:

1. A device for feeding and stacking forms in an upright position in a box having a substantially vertically oriented inlet opening with stop means near its top, comprising:

belt means forming an endless loop, a portion of which is operative adjacent said opening to bring subsequent forms from below up into the box;

lower and upper roller means for guiding said belt means toward said opening at an acute angle therewith, said lower roller means being located adjacent the bottom of said opening intermediate said opening and said belt means and extending well above and below the lowermost extent of said opening, said upper roller means being located above said lower roller means and on the opposite side of said belt means, said upper and lower roller means engaging said belt means at engaging points spaced closer together than the length of one of said forms;

a drive roller positioned below said lower roller and drivingly engaging said belt means;

a stationary guide sheet for the forms extending in opposed relationship with said belt from the region of said drive roller to a point above the uppermost extent of said lower roller means, said guide sheet having an upper edge defining a release edge which serves a dual function of overcoming adhesion forces between the uppermost end of the form and said lower roller, as well as serving to snap out the lower end of each form into the plane of said opening when said form passes said release edge; and a retarding surface provided on said stop means near the top of said opening, and forming a downwardly directed acute angle with respect to the plane of said opening, for frictionally retarding the leading edge of a form thrust upwards, whereby bouncing effects are minimized.

2. A device according to claim 1, wherein said drive roller operates on said endless loop of said belt means from the outside thereof, and further comprising conveyor means for continuously fed forms provided below said drive roller, and selectively operable guide means for deflecting the leading edge of a form between said drive roller and said belt means.

3. A device according to claim 2, wherein said guide means are a pivoted cam operated by an electromagnet positioned such that its action to rotate said cam is assisted by the frictional forces of a form advanced to engagement with said cam.

4. A device according to any preceding claim wherein said drive roller is external to said endless belt loop and further comprising means for retaining said belt in engagement with said drive roller over an angle of rotation, $V_1$, and in engagement with said upper roller means over an angle of rotation, $V_2$, the portion of said belt between said drive roller and upper roller means being no longer than the length of one of said forms, said forms being transported in contact with the outer surface of said belt loop, each form being subjected to a higher velocity at said upper roller than at said drive roller owing to the bending of the belt about said rollers, whereby each form is stretched when engaging said belt between said upper and drive rollers.

* * * * *